United States Patent [19]

Maeda et al.

[11] 4,059,956

[45] Nov. 29, 1977

[54] TOUCH TYPE CONTACTLESS SWITCH STRUCTURE FOR ELECTRONIC WRISTWATCHES HAVING INSULATIVE MEMBER PRECLUDING ESTABLISHMENT OF SHUNT PATH BY FOREIGN MATTER

[75] Inventors: Hidetoshi Maeda, Tenri; Takehiko Sasaki, Yamatokoriyama, both of Japan

[73] Assignee: Sharp Kabushiki Kaisha, Osaka, Japan

[21] Appl. No.: 647,154

[22] Filed: Jan. 7, 1976

[30] Foreign Application Priority Data

Jan. 10, 1975 Japan ..... 50-6567[U]

[51] Int. Cl.[2] ..... G04B 19/30; H01H 35/00

[52] U.S. Cl. ..... 58/23 R; 58/50 R; 200/52 R; 200/159 R; 200/DIG. 2

[58] Field of Search ..... 58/23 R, 50 R, 90 B, 58/88 R; 200/159 R, DIG. 2, 52 R; 340/365 C; 307/116

[56] References Cited

U.S. PATENT DOCUMENTS

| | | | |
|---|---|---|---|
| 3,737,670 | 6/1973 | Larson | 307/116 |
| 3,757,322 | 9/1974 | Barkan et al. | 340/365 C |
| 3,823,550 | 7/1974 | Bergey | 58/50 R |
| 3,983,690 | 10/1976 | McClintock | 38/50 R |

*Primary Examiner*—James R. Scott
*Attorney, Agent, or Firm*—Birch, Stewart, Kolasch & Birch

[57] ABSTRACT

An electronic wristwatch is provided with a touch type contactless switch structure for the purpose of altering the operational mode thereof, which comprises a pair of switch electrodes one being disposed on the viewing window in the engagement relationship with a portion of the operator body and the other being constituted of the enclosure thereof made of electrically conducting material. The one electrode is a film of transparent conductive material and, has an end area leading to the movement accommodated within the interior of the wristwatch. Both of the electrodes are isolated from each other via an electrically non-conducting member of low-melting point glass disposed therebetween which includes an extension overlaying the one electrode at the peripheral portion of the viewing window for allowing for moisture invasion.

4 Claims, 3 Drawing Figures

TOUCH TYPE CONTACTLESS SWITCH STRUCTURE FOR ELECTRONIC WRISTWATCHES HAVING INSULATIVE MEMBER PRECLUDING ESTABLISHMENT OF SHUNT PATH BY FOREIGN MATTER

BACKGROUND OF THE INVENTION

The present invention pertains to an improved touch type contactless switch structure for use in electronic wristwatches.

Generally, electronic contactless switches of the touch type are more advantageous than the conventional mechanical switches, such as a stem in the art of electronic wristwatches, because of their easy manipulations and easy implementations. By way of example, a typical touch type contactless switch structure has been proposed which includes a viewing window covered with a transparent touch electrode engageable with a portion of the human body and connected to a wristwatch movement in isolation from the enclosure of the wristwatch which is of an electrically conducting nature. Due to moisture invasion, the possibility of providing a shunt path between the touch electrode and the enclosure will be occasionally experienced.

Accordingly, it is an object of the present invention to provide an improved touch type contactless switch structure allowing for moisture invasion.

BRIEF DESCRIPTION OF THE DRAWINGS

Other objects and many of the attendant advantages of the present invention will be readily appreciated as the same becomes better understood by reference to the following detailed description considered in conjunction with the accompanying drawings in which like reference numerals designate like parts throughout the figures, and wherein.

DETAILED DESCRIPTION OF THE INVENTION

Figure 1:
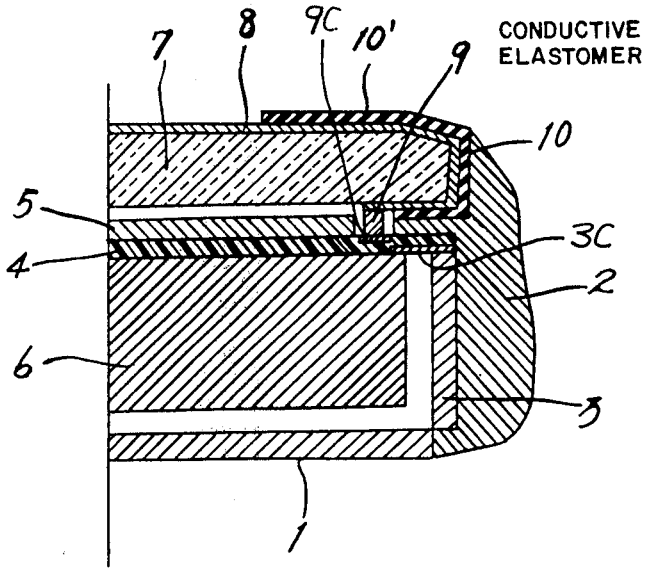
FIG. 1 is a cross sectional view of one preferred form of an electronic wristwatch constructed in accordance with the present invention.

Referring now to FIG. 1, there is illustrated a cross sectional view of an electronic wristwatch provided with a touch type contactless switch structure of the present invention. As viewed from FIG. 1, a watch case back or basement 1 always is in contact with the operator's arm when the electronic wristwatch is worn thereon. The basement 1 is generally made of electrically conducting material such as metal to thereby serve as one electrode or one important component of the touch type contactless switch structure. An enclosure 2 and an inner frame 3 also are both made of electrically conducting material and held in electrical engagement with the basement 1. A printed circuit board 4 of ceramics or plastics carries a digital display 5 on its upper surface including, for example, light-emitting diodes or liquid crystal units, and a movement electronics 6 implemented with integrated circuit technology on its lower surface together with interconnections therebetween. Electric interconnection between the basement 1 and the movement electronics 6 is accomplished by a circuit loop including the enclosure 2, the frame 3 and a conducting pattern metal leaf 3C.

A touch electrode 8, that is, another important component of the touch type contactless switch structure is established on the upper surface of a front glass sheet or viewing window 7 which is disposed over the digital display 5. The fabrication of the touch electrode 8 is accomplished by the deposition of a layer of electrically conducting, transparent material such as stannic oxide ($S_nO_2$) and indium oxide ($In_2O_3$). These materials have advantageously good adhesion to glass sheet. While fabricating the touch electrode 8, the layer also extends toward the side and rear walls of the viewing glass window 7. The extension of the end area of the layer 8 is oriented toward the interior of the wristwatch for accommodating the movement therein and is therefore connected with desired conducting leaves 9C disposed on the printed board 4 through a connector member 9 such as conductive rubber. Electrical isolation between the touch electrode 8 and the enclosure 2 is provided via an electrically non-conducting or insulating member 10 such as low-melting point glass. So as to prevent an undesirable shunt path between the touch electrode 8 and the enclosure 2 due to moisture invasion, the insulating member 10 is provided with an extension 10′ overlaying the touch electrode 8 at the front surface or the viewing window of the wristwatch.

Figure 2:
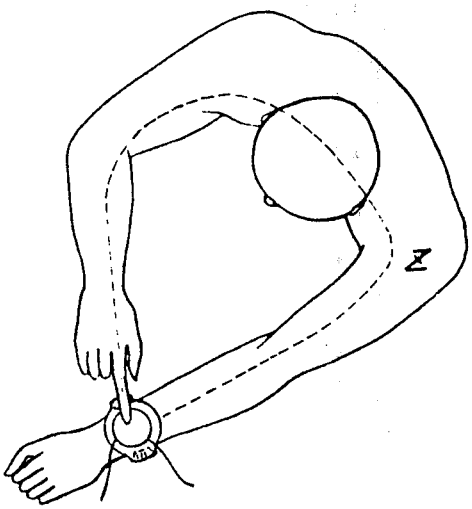
FIG. 2 is a perspective view of the electronic wristwatch of FIG. 1 in the operation state.

With such an arrangement, as illustrated in FIG. 2, when the operator puts on the electronic wristwatch and touches his hand not carrying the wristwatch to the touch electrode 8 provided on the glass window 7, a current loop will be established as depicted by a dotted line so that the resistance Z of the operator's body manifests between the touch electrode 8 and the enclosure basement 1. Then, the resistance Z is operatively connected to the movement electronics 6, for the purpose of altering the operational mode of the wristwatch. At this time, the touch type contactless switch structure is placed into its ON state.

Figure 3:
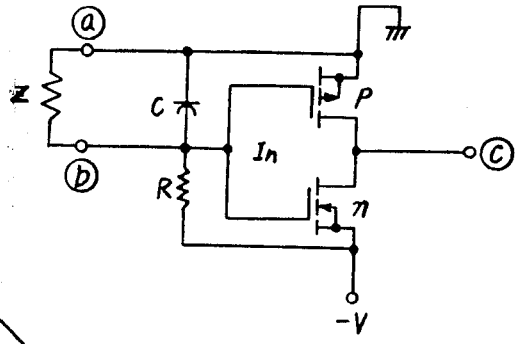
FIG. 3 is a circuit diagram of a utilization circuit of a touch type contactless switch.

In FIG. 3 illustrating a utilization circuit including the above discussed contactless switch structure, a point ⓐ corresponds to the enclosure basement 1 and a point ⓑ corresponds to the thin-film transparent electrode 8, respectively. A switching circuit comprises a C-MOS inverter $I_n$ which has two input terminals ⓐ and ⓑ associated with the enclosure basement 1 and the thin-film transparent electrode 8.

Detailed description of such utilization circuit is fully illustrated and described in copending U.S. Pat. application Ser. No. 575,731 entitled SWITCHING MECHANISM FOR ELECTRONIC WRISTWATCH, filed on May 8, 1975, by Takehiko Sasaki and Hidetoshi Maeda, which is incorporated hereinto.

It will be now assumed that water drops are added to the upper surface of the front glass. In this instance, substantial distance between the touch electrode 8 and the enclosure 2 is increased by the insulating member extension 10′ to an extent to prevent the shunting therebetween due to moisture invasion, since the insulating member extension 10′ extends over the touch electrode 8 at the front viewing window 7. In the case that the insulating member 10 is made up of low-melting point glass, it exhibits the effects of condensing the water drops. The insulating member 10 may be either deposition films such as silicon oxide, aluminum oxide and yttrium, electrically non-conducting paints or volatile materials such as silicone resin, in addition to the above discussed low-melting point glass.

While only certain embodiments of the present invention have been described, it will be apparent to those skilled in the art that various changes and modifications may be made therein without departing from the spirit and scope of the invention as claimed.

What is claimed is:

1. In an electronic wristwatch including an enclosure, a viewing window and movements accommodated within the interior of the enclosure, a touch type contactless switch structure operated by the wearer of the watch comprising:

a film of transparent electrode disposed on the viewing window for engagement with a portion of the body of the wearer, said electrode film serving as one electrode of said contactless switch structure;

said enclosure being engageable with the wrist of the wearer and made of electrically conductive material for serving as another electrode of said contactless switch structure;

an insulating member provided between the electrode film and the enclosure for establishing electrical isolation therebetween; and an extension provided at the one end of the insulating member in a position to overlay the electrode film and thus the viewing window in an amount sufficient to preclude establishment of a shunt path between said electrodes by the accumulation of foreign material on said insulating member.

2. A touch type contactless switch structure as defined in claim 1 wherein the electrode film and the enclosure are connected to a C-MOS switching circuit disposed within said enclosure.

3. A touch type contactless switch structure as defined in claim 1 wherein the insulating member is made of low-melting point glass.

4. A touch type contactless switch structure as defined in claim 1 wherein said foreign material on said insulating member is moisture and wherein said insulating member is made of low-melting point glass for condensing ambient moisture into drops on the extension of said insulating member, said insulating member being of a size such that drops characteristically formed thereon are of a lesser size than the overlay of said extension on said electrode film.

* * * * *